US007062442B2

(12) United States Patent
Berg et al.

(10) Patent No.: US 7,062,442 B2
(45) Date of Patent: Jun. 13, 2006

(54) METHOD AND ARRANGEMENT FOR SEARCH AND RECORDING OF MEDIA SIGNALS

(75) Inventors: Jakob Berg, Stockholm (SE); Rickard Berg, Stockholm (SE); Tomas Ahrne, Enskede (SE)

(73) Assignee: Popcatcher AB, Stockholm (SE)

( * ) Notice: Subject to any disclaimer, the term of this patent is extended or adjusted under 35 U.S.C. 154(b) by 740 days.

(21) Appl. No.: 10/047,532

(22) Filed: Oct. 23, 2001

(65) Prior Publication Data

US 2002/0120456 A1 Aug. 29, 2002

Related U.S. Application Data

(60) Provisional application No. 60/274,904, filed on Mar. 9, 2001.

(30) Foreign Application Priority Data

Feb. 26, 2001 (SE) ..... 0100642

(51) Int. Cl.
*G10L 21/00* (2006.01)

(52) U.S. Cl. ..... 704/270; 704/278

(58) Field of Classification Search ..... 704/266, 704/270, 276, 278; 707/6; 725/61
See application file for complete search history.

(56) References Cited

U.S. PATENT DOCUMENTS 4,520,499 A * 5/1985 Montlick et al. ..... 704/266
5,649,060 A * 7/1997 Ellozy et al. ..... 704/235
5,675,709 A * 10/1997 Chiba ..... 704/266
5,728,962 A * 3/1998 Goede ..... 84/609
5,739,451 A 4/1998 Winksy
5,870,583 A 2/1999 Maeda
5,924,071 A * 7/1999 Morgan et al. ..... 704/278
6,088,455 A 7/2000 Logan
6,182,200 B1 * 1/2001 Duvall et al. ..... 711/165
6,185,527 B1 2/2001 Petkovic
6,260,011 B1 * 7/2001 Heckerman et al. ..... 704/278
6,272,461 B1 * 8/2001 Meredith et al. ..... 704/278
6,438,513 B1 8/2002 Pastor
6,614,986 B1 * 9/2003 Tognazzini ..... 386/46
6,697,796 B1 * 2/2004 Kermani ..... 707/3
6,728,682 B1 * 4/2004 Fasciano ..... 704/278

* cited by examiner

*Primary Examiner*—Martin Lerner
(74) *Attorney, Agent, or Firm*—Bacon & Thomas, PLLC

(57) ABSTRACT

The method and a system is for locating and recording time-limited signal sequences in media channels that may contain undesirable signal components, e.g., recording music in radio transmissions. The signals are continuously buffered in a memory. The user identifies a desired source material. Out of this desired source material a section may be taken as a search key. The device may also select search keys automatically. If a second instance of the search key is detected, signal sequences that in time are connected to the search keys are compared. The signal sequences that by comparison are substantially identical are identified as belonging to the same, wanted, source material. The next step is an iteration of the above procedure results in a longer and higher quality segment of source material than the initial common segment.

28 Claims, 5 Drawing Sheets

METHOD AND ARRANGEMENT FOR SEARCH AND RECORDING OF MEDIA SIGNALS

PRIOR APPLICATION

This is a continuation-in-part application of U.S. Patent Provisional Application Ser. No. 60/274,904; filed Mar. 9, 2001; and claims priority from Swedish Application No. 0100642-8, filed 26 Feb. 2001.

TECHNICAL FIELD

The invention refers to a method and a system for recording time-limited signal sequences in media channels that may contain undesirable signal components. For example, the invention may be used for recording music in radio transmissions.

BACKGROUND AND SUMMARY OF THE INVENTION

It has since the radio and television techniques first were developed, been popular to record both music and other transmissions over radio and television. Examples of this could be songs, films and music events. Recordings are made both to be able to save and repeatedly enjoy a particular appreciated transmission, as well as to not have to be restricted to listen/view only at the time of transmission. One problem with recording, e.g., music from radio transmissions, is that the listener in most cases does not know which song will be transmitted. In many cases, the song has already been played for a while before it is possible to recognize that it is a song that should have been recorded from the beginning. In addition to this, it is time-consuming to pay attention to the radio for a certain song or watch for a certain film if the transmission time is unknown.

As prices of music and film on CD, DVD and other storage media increase, new less expensive alternative ways of making such entertainment available have been developed. The Internet has now a bigger role in a more or less legal or illegal spreading of music in different file formats. In particular, music and film are copied and made available for the general public over the Internet in, for instance, MP3 format. The interest for free music is shown, for instance, by the large number of users of home pages with search engines that give them availability of free music; an example of this is Napster.com.

It is also interesting to note that a great proportion of the persons who listen to music has limited knowledge of which artists they are listening to and only listens to radio stations with mixed, for them not always known, artists. That the consumer is more interested in music from a certain genre than in specific artists is also shown in an increasing interest in music CD's with mixed groups/artists.

The patent application DE 19810114 describes a method of searching and matching previously stored parts of music, called keys, against transmitted music over chosen radio channels for automatic recording of a chosen song when these keys match the transmitted song. For each song that is to be searched for and recorded, a start key in the form of a part of the beginning of the song and an end key in the form of an end-piece of the song, is stored in a memory in the radio. Those in advanced chosen keys are compared against everything that is transmitted over a number of radio channels and when a key is found, the part in-between is recorded. It is also possible to search for a certain type of music by storing category keys for matching and recording of a specific music category such as pop music, rock music, classical music or other type of music.

One disadvantage of this way of recording music is that only previously chosen music in the form of parts called keys of music previously stored on, e.g., a CD can be matched against radio channels for recording of wanted music. It is not possible to extract one or more keys from any song that is played on the radio for continuous matching against radio channels, enabling one to automatically get a full-length version of that song. Another disadvantage is that it is not possible to record music completely without undesirable signal components since everything between the keys is recorded, which will mean that undesirable signal components such as talk and distortion due to bad transmission will be included in the songs. It is common that radio talkers or commercials interrupt the music in radio transmissions.

The present invention is meant to solve the above mentioned problems by supplying a procedure and a device for the searching and recording of desired source material in media channels containing undesirable signal components, where the same source material is transmitted at least twice, either in the same channel or in different channels. A piece of source material can be a song, a film or anything else that is time-limited and can be considered as separate from other material. More particularly, if needed, the signals are continuously buffered in memory in a receiving member, over at least one media channel. The next step may involve identifying and choosing a desired source material by an activation member connected to the receiving member. Out of this desired source material, a section or a representation of the section may be taken as a search key. The device may also select search keys automatically in one version of performing the invention. The media signal located around the search key may then be stored in a memory. The search key is compared to other stored media signals or current transmissions of media signals. If a second instance of the search key is detected, signal sections that in time are connected to the search keys are compared. The signal sequences that by comparison have been found to be substantially identical are identified as belonging to the same source material. Identifying common segments between the first signal segment and the second signal segment enables one to find the beginning and end of the commonality, and thus the beginning and end of the whole or part of the source material. These common segments may be stored for later use.

The next step may be an iteration of the above mentioned detecting of search key, storage in memory and comparison among media signals where signal segments that are identified as originating from the same source material can complement the earlier found common segment. This can result in a longer, more complete and higher quality segment of source material than could be gotten initially.

The iteration may be terminated by a threshold value for termination and whereby an acceptably long common segment of sufficient quality has been identified and stored in the final memory place for playing later on.

The invention gives the user unique new ways of continuously obtaining recordings of source material, such as music and film. If this invention is used for radio transmissions, the invention can continuously record all songs repeated on the radio and save them in a play list for later use. In addition to this, when the user of the device hears a song he wants to record, the user only has to push a button to automatically get a full-length recording of that song. The invention may distinguish between music, commercials and talk on the radio.

BRIEF DESCRIPTION OF THE DRAWINGS

The enclosed figures are referred to for a better understanding of the invention and illustrate one way of implementing the invention, where.

DETAILED DESCRIPTION

Figure 1:
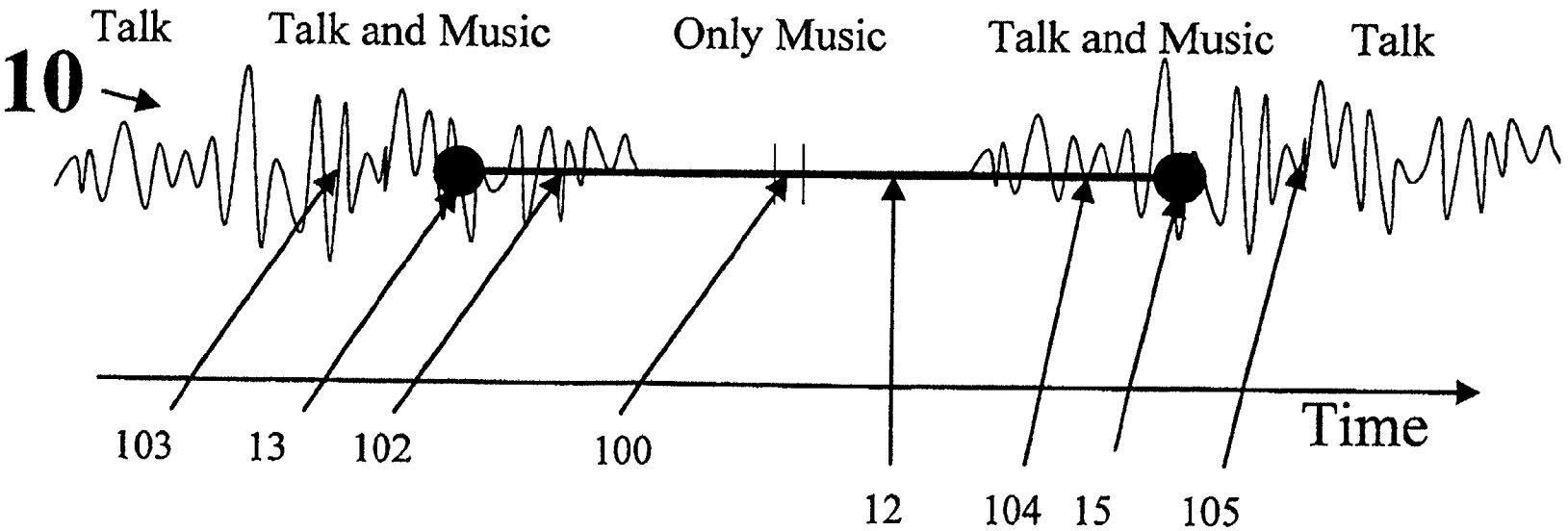
FIG. 1 schematically illustrates a procedure for creation of a search key of a section or a representation of a section of the music that is stored in a memory for comparison and matching against the same piece of music over for instance radio channels.

Below follows a procedure and an arrangement for the searching and recording of source material in media channels containing undesirable signal components, where the same source material is transmitted at least twice, either in the same media channel or in different media channels. The method distinguishes between desirable source material and undesirable material, such as talk, commercials and distortions. Examples of source material could be music, film, and similar. The searching and recording of hit songs in a radio transmission have been used as an illustrative example in this application. It is to be understood that the invention is not limited to identifying and recording hit songs; it may be used for films, music videos and other kinds of source material as well. The searching and recording may be done by an iterative procedure comprising finding, comparing and storing of signal segments that are indicated by search keys derived from the source material that is to be recorded.

A user can by using the method and device, according to present invention, at any moment choose to record a source material that currently is transmitted over a media channel to a receiving member. In one way of performing the invention, the user will also automatically have source materials recorded from the media channel. The devise will automatically identify the beginning and end of the full source material or parts of the source material and save these sections for later use.

An example of a source material could be a hit song that is transmitted over a radio channel to a radio receiver. By using the method, the listener may after a while and without further manual effort obtain a high-quality full-length version of the hit song, stored in the device. The user can at any time during the playing of the song initiate a recording of the full version of it by simply pressing a button. By using the method of the invention, the device may also automatically extract music in a radio transmission and record each song separately. Thus enabling the user of the device to have continuously updated lists of the separate songs that are played over the radio. This invention gives the user of the invention at least two new unique ways of obtaining music. One way is pushing the button when hearing a desired song, and the other way is by having the device automatically record songs in whole and save them in a play list.

Media signals, such as radio transmissions and television transmissions, that are sent over media channels to a receiver organ, such as a radio, television, PC or similar equipment is temporally stored in one or more buffer memories. In the buffer memory of the device of the present invention, the older stored media signal may continuously be replaced with the latest transmitted media signal of one or many channels. The media signals are accessible to the user, who may activate the device.

Through this continuous buffering and temporary storage of media signals to one or more memory places, buffer memories, adjusted for, e.g., five days of temporary storage, it is possible to at a moments notice record complete source materials, as described in detail below. The recording is even possible when the user decides to record late in the transmission of the source material.

When the user or the device indicates that a certain source material is to be recorded, a section or a representation of the section of the media signal at that point in time may be selected as a search key. The search key may also be a derivation of the full source material.

The device may also save a sufficiently long section of the recorded media signal surrounding the search key; for hit songs a sufficient length could be 5 minutes before and after the time of activation. This procedure gives the user the whole transmission of the source material that was transmitted at that time. The activation of the recording function may be done by pressing a button, turning a wheel or by activating a handle or any other member on the receiver. The activation may also be done automatically by the device. This automated activation may be triggered randomly, periodically, or may be triggered by some recognizable feature of the transmission. In the example of music in a radio transmission, this enables the device to automatically construct lists of music that has been played on the radio. The music may be stored much like on an ordinary CD player and gives the user a possibility of listening to one song after the next.

The necessary length of the recorded sections before and after the time of activation can be determined by estimating likely lengths of that type of source material. For hit songs, 5 minutes before and after the time of activation should be enough in most cases. The media signal transmission of the source material stored in memory might not be free from undesirable signal components. In radio transmissions, for example, it is very common to interrupt the music with talk, at least in the beginning or at the end of a song. Sometimes, the disc jockey may even break in the middle of the playing of a song, although most of the time a piece of music is played on the radio, a large part of it is transmitted without any interruptions.

Another problem is that it is not known where the source material starts and ends in the stored recording. This invention provides a solution to how to find the beginning and end of a source material in a continuous media signal, e.g., the beginning and end of a song in a continuous radio transmission. If the device is automatically activated, it may continuously record music that is repeated on the radio and thus be able to automatically save songs from the radio.

FIG. 1 illustrates a procedure for creating a search key 100 of a section of a source material or a representation of that section. The media signal 10 may, e.g., be a piece of music 12 that may contain undesirable signal components 102, 104 and other undesirable segments 103, 105 before and after the song 12. The desired source material 12 is marked with a bold line in FIG. 1. The segment 12 has a start 13 and an end 15. The search key 100 may be used for detecting previous transmissions and future transmissions of the same source material, e.g., the same piece of music. The detection may be done through matching and comparison of the content of the search key with segments of the media signal stored in the buffer memory or being transmitted later on. The detection of previous or future transmissions of the desired source material may be carried out by a direct match of the search key. It may also be carried out by a process of identifying sections of the transmission that may contain the source material and then checking these sections in one or many ways and in one or many steps to test if they actually are from the desired source material. Preferably, the media signal 10 is longer than the desired source material 12 to make sure the entire source material 12 is eventually recorded.

When saving parts of the media signal for later comparisons, the media signal 10 should extend a time period before and after the search key that is long enough to accommodate the full source material. As an example, most popular pieces of music are shorter than 5 minutes and since the recording activation might take place any time during the play of that piece of music, it is desirable to save about 5 minutes before and 5 minutes after the time of activation to ensure that a whole piece of music is captured. In this way the media signal 10 may be about 10 minutes. Of course, any time period could be selected, as desired.

When a second substantially identical instance of the search key 100 is detected, signal sections that in time are connected to the search keys are compared. Signal segments that by comparison among themselves are found to be substantially identical are identified as originating from the same source material 12. Identifying common segments between the first signal segment and the second signal segment enables one to find the beginning and end of the commonality, and thus the beginning and end of the whole or part of the source material.

As explained below, the iterative process of the present invention reduces the corrupted segments 102, 104 to a minimum by gradually replacing those segments with uncorrupted clean signal segments copied from other transmissions of the same source material that either have been transmitted in the past or will be transmitted in the future. An important assumption of the present invention is that the receptions of the desired source material are substantially identical for every transmission of the same source material, e.g., the reception of a song is close to identical every time it is transmitted over the radio. While the undesirable signal segments such as talk, commercials and distortions usually are different each time the same song is played.

Figure 2:
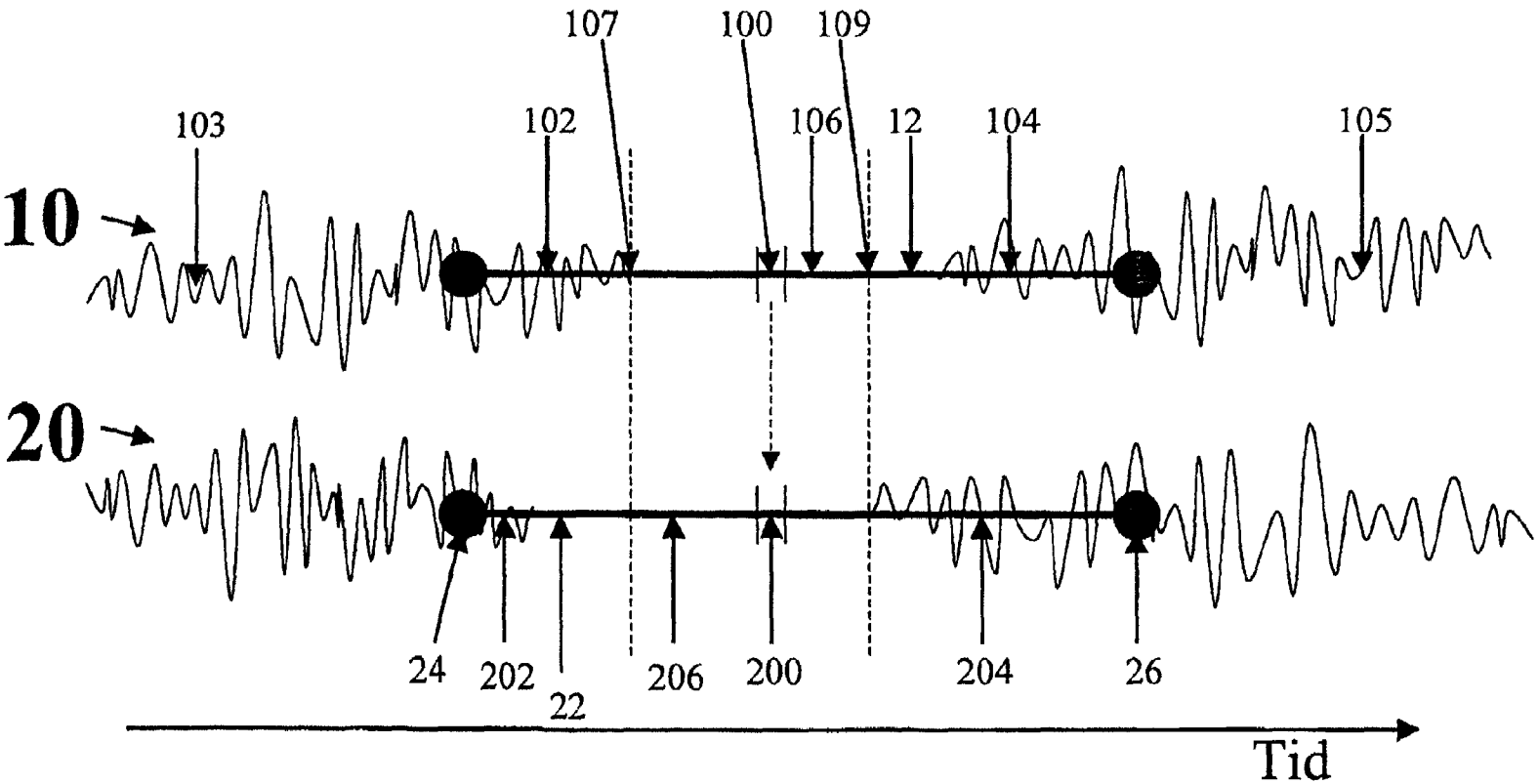
FIG. 2 illustrates an example of a procedure for recognition of the music by use of the stored search key.

FIG. 2 displays a procedure for detecting a second section of a media signal 20 that contains substantially identical parts to the section 10 and thus can be considered originating from the same source material, by the use of the matching of the search key 100 with a second identical, or close to identical, instance of that search key 200. It should be noted that the media signal 20 has a shorter corrupted segment 202 in the beginning of the desired source material 22, that has a beginning 24 and an end 26. However, the signal 20 has a relatively long corrupted segment 204 compared to the segment 104 of the signal 10. The parts of the two media signals that are identical is the time between 107 and 109 and this may be saved as the common segment. One object of the iterative process of the present invention is to take advantage of the relatively short distorted segment 202 but ignore the relatively long segment 204.

Preferably, media signals are buffered, as mentioned above, on a continuous basis in the buffer memory. The media signal 20 that is detected by recognizing that the search key 100 is identical, or close to identical, to the second instance 200 of that search key, can then be further tested for likeness by expanding the testing, possibly with other methods, beyond the area of the search keys. When sufficient evidence is present that they originate from the same source material, segment 20 may be copied to a memory or its start and stop points in the memory are stored. This may be done by copying a sufficiently long segment before the second instance of the search key 200 and a sufficiently long signal segment after the second instance of the search key 200. This prevents signal sections that may be used in further processing to obtain a copy of the desired source material from disappearing when the buffer memory is refilled with new media signals. In one embodiment of the invention, instead of moving the media signal between memories, the device may save the media signal in its original place but not over-writing it for a predetermined time.

The identification of the search key and the saving of the media signal results in two media signals, i.e., the media signals 10, 20, being stored. The media signal 20 is compared with the initially stored media signal 10. The parts of the two media signals 10, 20 that are identical, or close to identical, are treated as if they are free from undesired signal components and therefore represent at least part of the desired source material. This could be, e.g., part of or a whole desired song, without any interfering talk or commercials. In this case, a segment 106 of the signal 10 is identical to a segment 206 of the signal 20. The common segment may be saved for later use, for example, to be listened to. The segments before and after the segments 106, 206 where the media signals 10, 20 are not matching or identical are assumed to represent undesirable signal components. More particularly, segment 106 may be stored in memory and be added to by future iterations until the entire desired source material 12 has been stored in the final memory or a threshold value for termination is reached. The segment 106 of the source material 12 is, in this way, available for playing and the segment 106 has an identified end 109 and an identified beginning 107.

Since only the portions of the media signals that are identical or substantially identical are identified, only a shorter section 106 of the desired source material 12 is likely to be identified the first time the section 106 is saved. If the user is lucky he or she may get the whole source material, e.g., a whole song, the first time the second instance of the search key is found.

In one simpler way of performing the invention, the device only works through the process once. The first found common segment that comprises a copy of the search key is used to identify the beginning and end of the source material. This process is described above in FIGS. 1 and 2. This simpler version of the invention may only give the user of the device the first identified common segment as the final version and thus giving the user a smaller chance of finding the whole source material.

To increase the chances of finding the whole source material, e.g., the entire song 12 on the radio, the above-described procedure is repeated numerous times. Thus, the steps of detecting media signals, storing the detected media signal in a memory and comparing the media signals to find matching common segment may continue. One object is to detect more common segments by pairing identical media signals that supplement the previously identified signal segment 106 by adding the new matching section to the signal segment 106 stored in the final memory. This iteration leads to a longer and longer common segment 106 stored in the final memory.

Figure 3:
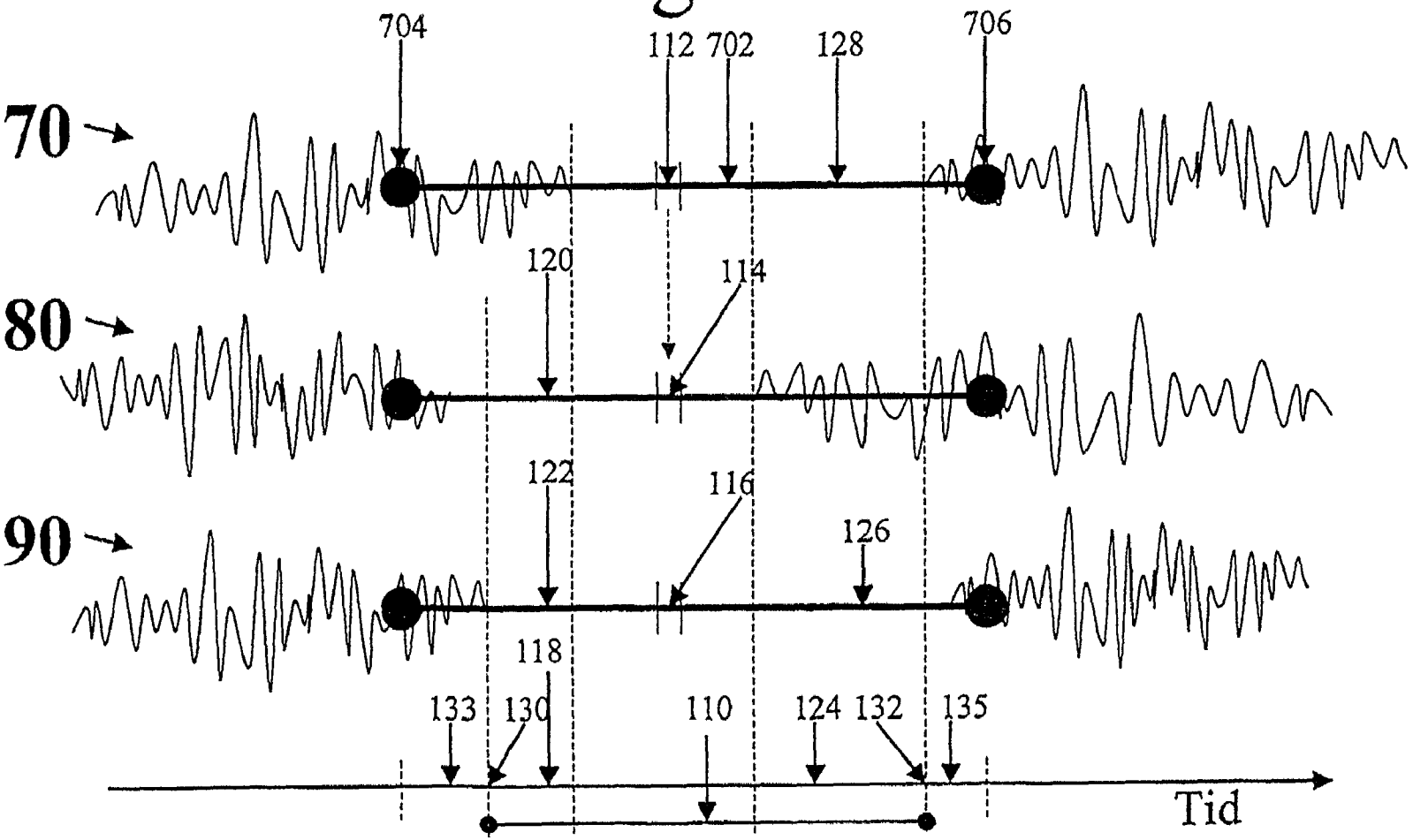
FIG. 3 illustrates an example how a more complete piece of the music is created out of a repeated number of detections, comparisons and storage of substantially identical music sequences by continuous matching of search keys against pieces of music that are transmitted over for instance radio channels.

FIG. 3 illustrates how an almost complete and non-corrupted source material 110 may grow out from the repetitive process of matching the search key 112 of the media signal 70, the search key 114 of the media signal 80 and the search key 116 of the media signal 90. The media signal 70 contains the desirable source material 702 that has a beginning 704 and an end 706. It should be noted that the media signals 70, 80, 90 contain the same source material and the search keys 112, 114, 116 also are identical or close to identical. A section 118 may be added to the common segment stored in the final memory because the section 120 of the signal 80 is identical to the section 122 of the signal 90. Similarly, a section 124 may be added to the common segment stored in the final memory because the section 126 of the media signal 90 is identical to the section 128 of the media signal 70. If the start point 130 and the end point 132 represent the start and the end of the common segment, the segment 110 almost covers the entire source material 702. The only missing segment is a segment 133 at the beginning 704 and a segment 135 at the end 706 of the signal segment 702. The procedure may continue the iteration in this manner until the entire source material has been recorded.

To prevent the iterative search procedures, including the comparison and add-on procedures, to go on forever, a threshold value for termination may be set. This could be a predetermined number of iterative steps for the iterative search procedure. Another alternative could be to use a known and identifiable characteristic of a media signal for termination of the process. The termination of iteration may also be triggered when the lengths of a number of added common segments are smaller than a certain value since this condition indicates that there might not be much more to be found of the full source material. The iteration may also be set to stop if no additional common segment has been added despite a certain numbers of identifications of identical source material.

When a common segment is found the first time, the common segment may be stored in a final memory and be ready for being played by the user. This will give the user the option to repeatedly enjoy the common segment, e.g., repeatedly enjoy a song by connecting a music-reproducing device to the final memory. Each song may over time be added to with new parts of the song and thus giving the listener a longer and more complete version of the desired music.

In another simpler way of performing the invention, the device works through the identification process as described above, as illustrated in FIGS. 1 and 2, and works through the iteration process as described above and in FIG. 3, but instead of adding the common segments together, the device only uses the longest possible identified part of the source material, the longest common segment, as the final version. This simpler version of the invention gives the user of the device a smaller chance of finding the whole source material, but this device may be easier to develop.

Figure 4:
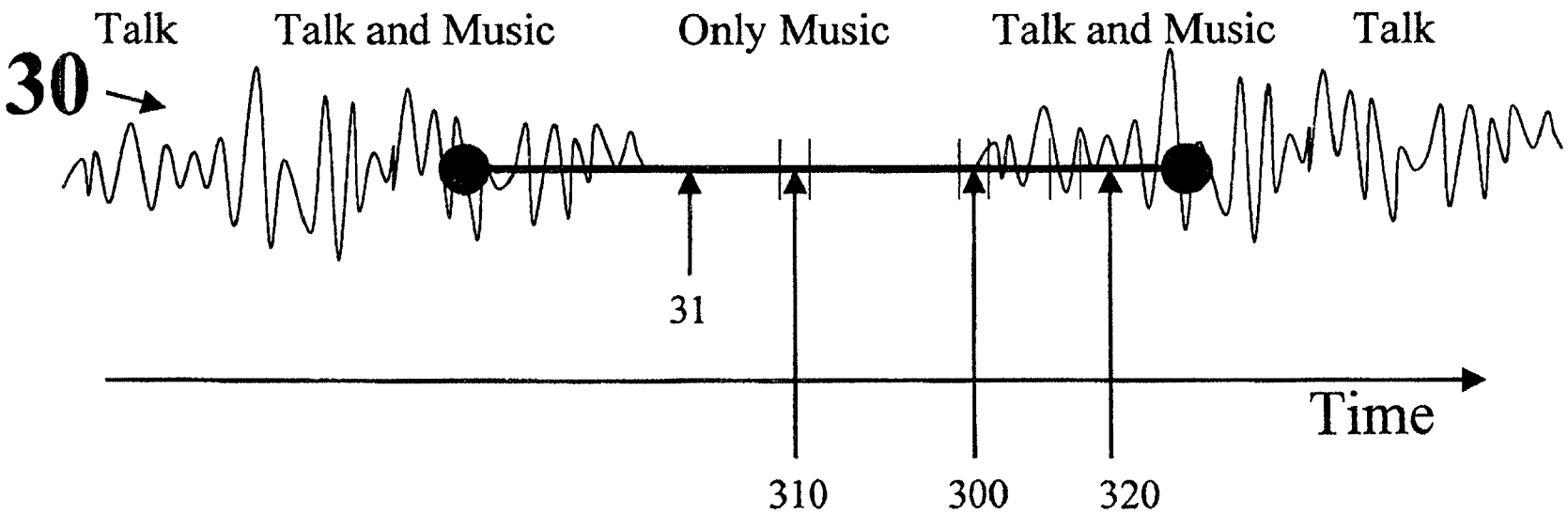
FIG. 4 exemplifies a procedure for creation of more search keys.

FIG. 4 illustrates an example of creating multiple search keys 300, 310, 320 in the media signal 30. This method is particularly useful when the media signal contains a substantial amount of undesirable signal components. The method increases the chances that at least one of the search keys 300, 310, 320, are free from undesirable signal components.

In the illustrated example, only search key 310 is free from undesirable signal components and can later be matched with an identical search key when the source material 31 is found in the memory or retransmitted. The search keys 300 and 320 are not likely to be matched in a later media signal because the undesirable signal components are not likely to be repeated exactly the same way in a later transmission. The procedure may be designed to detect supplemental pairs of identical signal segments to complement the identified common segment by adding these additional common segments to the common segment in the memory.

This method improves the chances of finding and identifying a non-corrupted part of the desired source material in memory or next time the source material is transmitted. This also speeds up the process of finding and obtaining an acceptable length on the desired source material 31. The whole procedure may be repeated in the iterative steps as described above.

Figure 5:
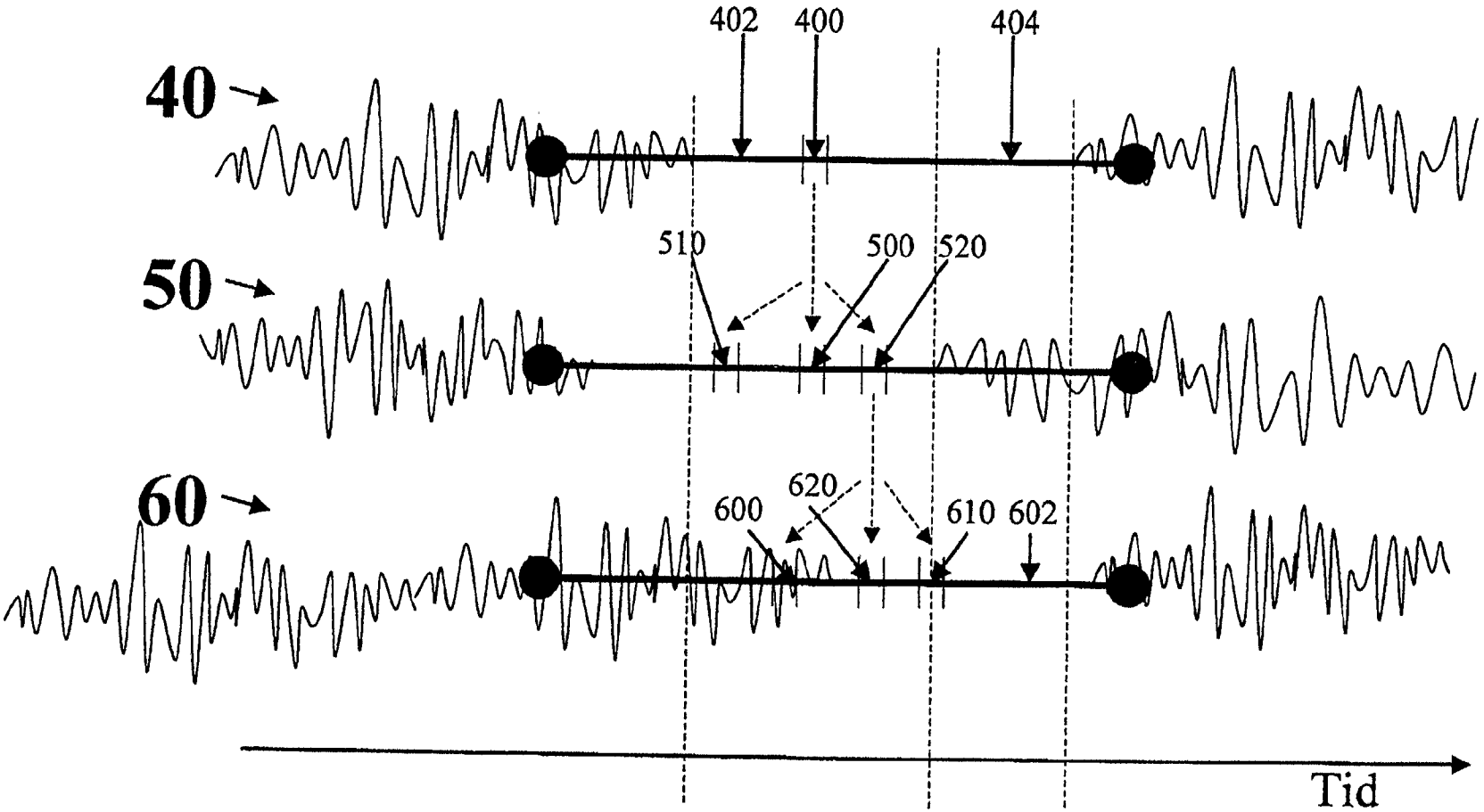
FIG. 5 shows an example of a procedure for creation of additional search keys after the matching and detecting with a first search key.

FIG. 5 shows a procedure for creating multiple search keys 500, 510, 520 of media signal 50, after matching and detecting of a first one search key 400, of the media signal 40. The procedure continues with comparing the three search keys 510, 500 and 520 with the media signal 60. The search key 520 is substantially identical to the search key 620 and thus indicates a match between the segments. As indicated above, the media signals 40, 50, 60 may contain the same source material but the three different media signals have different amounts of undesirable signal components, such as talk and commercials, interfering with the source material. This provides the opportunity to compare three stored versions 40, 50, 60 that contain at least parts of the same source material. Since there is a match between the search key 400 and the search key 500, a first common segment 402 may be saved in the final memory. The above iteration may then add common segments before and after the common segment 402 as other common segments are found by using the search keys.

Since there is a match between the search key 400 and the search key 500, the media signal 40 is assumed to at least in part originate from the same source material as the media signal 50. The difference is that both signals have a different amount of undesirable signal components. An important feature is that because there is a match between the search key 520 and the search key 620, the media signals 40, 50 are assumed to have common parts with the media signal 60, and that these then originate from the same source material. This means that signal segment 602 of media 60 signal is substantially identical to segment 404 of media signal 40, and this common segment can then be added to the common segment in the final memory. The whole procedure may be repeated in the iterative steps as described above.

One object of the iteration method of the present invention is to in the final memory acquire a full-length version of the source material that does not have any undesirable signal segments, i.e., talk, commercials, distortions, etc.

In an alternative embodiment of the present invention, the method identifies source material, such as hit songs on the radio, with the help of a search key that is a selected section of the source material or a representation of that section. For example, the search key may represent a very short section of a desired hit song or a representation of that section. The desired source material may be recognized by identifying similarities between the search key and the media signal.

There are a number of possible methods that can be utilized to determine the degree of similarity between the search key and a section of a media signal. For example, correlation may be used where a section of a media signal is convolved with other sections of the same or other media signals to obtain values that express the degree of similarity between the two sections involved. The higher the value the higher degree of similarity exists, and thus the higher the chance of them originating from the same source material.

In general, a correct match, where the section under investigation is actually from the same time period of the same source material from which the search key was taken, may yield a more distinct pattern with a much higher value at the match than the surrounding wrong time periods, the longer the section that is involved in the correlation process. Thus, it can be advantageous to use longer sections in the correlation process. But, longer sections also demand more processing power and therefore there is a practical limit to how long sections one can use.

Other methods can be used to determine similarities between sections of media signals. In a method called cancellation, the search key, as for correlation, is a section of a media signal, which is then compared to other sections of media signals. The search key and the section of media signal that are to be compared for likeness are first normalized in gain so that they have almost the same gain. Then the samples from one section are subtracted from the samples of the other section and the absolute values of these differences are summed up to get a final cancellation value. If the sections are exactly identical, the resultant value will be zero. In practical use, a correct match will yield a very low cancellation value. The method is called cancellation since the sections will cancel each other if they are identical, or near cancel each other if they are very similar.

It is also so for cancellation, as is for correlation, that the longer the sections that are involved in the process usually the more distinct a correct match will be.

Both above-mentioned methods, correlation and cancellation, will gain from using longer sections in the process. Since there will be a practical limit to how long sections that can be used due to, e.g., limits of processing capacity, modified versions of both correlation and cancellation have been devised. These methods simply consist of not involving every sample in the process, but instead taking every N:th sample, where N can be any number from 1 and up. N does not even have to be a fixed value, but can vary from step to step within the calculation of one processing value. The method of involving every N:th sample of the media signal could be used on most other methods for recognizing similarity between the search key and a section of media signal. The step sequence does not have to be the same from processing value to processing value. The same steps in the search key and the section under investigation within the calculation of each processing value should be used. These new devised methods have been named modified correlation and modified cancellation.

These modified methods can give very distinct results, when searching for a match and when searching for the beginning and end of source material, but the penalty from not using every sample in the process is that the average noise level away from a correct match can be higher than when all samples are involved.

In one way of performing the invention the device may solve the problem of comparing media signals that are transmitted with different gain by normalizing their respective gain as part of the comparison process. The normalization of gain could also be done as part of the process of recording the media signals. If the comparison method utilized to determine the degree of similarity between the search key and a media signal is the correlation method or any other method whose result is dependent on gain in the signal chain, then a method of compensation for gain variations could be applied to normalize the measurements. There are several possible methods, such as, in the case of audio, the use of an audio compressor of the kind that is often used by radio stations to prevent overloading of the transmitter while at the same time sounding as loud as possible.

One particular method of the present invention that has many advantages is to normalize the calculated similarity values with the sum of the absolute values of samples in the section of interest. This may effectively cancel the influence of variable signal gain, such as for example when a DJ plays the same song at two different occasions at different gain settings in the mixing console.

When correlation or modified correlation is used as a method to determine the degree of similarity between a search key section and a section of a media signal, it can be of use to know in advance about how high the correlation value at a correct match is expected to be. Since media signals that are almost identical are reviewed, which is so because they originate from the same source material, it is possible to know in advance how the expected section at a correct match could look like. The correct match must be very similar to the search key section. Therefore, it is possible to in advance calculate the expected correlation value at a correct match by simply correlating the search key section with itself and normalizing the result with the aid of the moving average of the absolute values of samples of the search key section. This value has arbitrarily been called a T-value. When looking for correlation values that can be the result of possible correct matches, one search criterion could be that the correlation value is near the expected T-value.

Another use for the T-value is when trying to determine the quality of recordings of the same source material. When several signal segments are found that have been determined to originate from the same source material, then it is possible to use the T-value to indicate something about their relative quality in regards to noise, interference and distortion. If instead of only calculating the T-value for a media signal at the correct match, the continuous T-value over part of or the whole section is calculated. This section may then be correlated with another section from the same source material and the resulting correlation values and corresponding T-values are compared. It must be noted here that the signal segments that are to be compared should be aligned in time and normalized in gain and that the number of samples in the calculation of the T-value should be the same as the number in the correlation. If the sections are identical, the earlier calculated T-values should be exactly the same as the later calculated correlation values. Any departure from the expected T-value may be due to some kind of unwanted signal alteration since it is assumed that both sections originate from the same source material. The greater the departure from the expected T-values, the greater the difference between the sections is likely to be. It may also be assumed that if the correlation values are close to the T-values then two sections are of high quality since it is unlikely that similar random disturbances corrupt both sections.

Many sections can be compared to get an indication of their relative quality. With three sections, sections 1 and 2 may be compared, then 1 and 3, and finally 2 and 3. This method of determining the quality of sections of media signals can be used to set a criterion for when a section will be accepted as good enough, and it can also be used to select sections of like quality. The latter can be important when pieces from different recordings of the same source material are spliced together to form a longer continuous section of the source material. It could be disturbing to the user to suddenly note a jump in quality when playing the spliced longer section.

When using cancellation as the method to determine the similarity between sections of media signal, then the expected value at a match may be close to zero. The degree of similarity determines how far from zero the cancellation value is. Cancellation can be used to determine when sections are similar, and the method can also be used to determine the relative quality between sections when they have been determined to originate from the same source material. The more two sections from the same part of the same source material have been contaminated with noise and other disturbances, the more the cancellation values are expected to depart from zero although the sections are normalized in gain and correctly aligned in time.

In one alternative, the searching and matching of sections of media signals is performed only on a sub-set of the available data and/or a transformation of that data. This could be done in many ways. For example, the device may use only a fraction of the samples building up the material when creating a search key. Another way is that the device may record the media signal in two or more separate files, one or more search files and one or more files for later use, e.g., for playing. A search file may be a recording of the media signal but of lower bandwidth, or might be a file that only contains certain frequency intervals. A search file may also be a representation of the recorded media signal. The search file can be used to create the search key and also to search for a second incident of the search key. The search file may also be used to find the beginning and end of the source material. For music transmitted over radio, a search file could be a separate recording of the media signal at a lower sample rate, e.g., 6 kHz. This search file can be used to create the search key as well as to find another incident of the search key and also for finding the beginning and the end of the source material. Then this start and stop information can be used to find the start and stop of the source material in the full-quality recording. One reason to use separate search files is to decrease the need for processing power.

In another way of performing the invention, the device creates a search key and searches for it in files stored on a hard drive. If only the processor speed is fast enough, the factor limiting the speed of the device is the speed of accessing the stored media signal on the hard drive. The downside of this is that the hard drive has to be access continuously, thus continuously using power. In another way of performing the invention, the device_may create a plurality of search keys continuously as the media signal is transmitted and searches simultaneously for many search keys. Since the search may be done completely in the RAM memory of the device this decreases the need for accessing information from an eventual hard drive and thus saves power for the device. For example, by loading one hour of music or search file into RAM memory from the hard drive or the transmission, and searching the RAM memory with many search keys, the hard drive is given a rest and thus the device may save battery power and also work faster.

In another way of performing the invention, the device may perform the searching and matching of signal sections in a hierarchical way, first selecting out a number of possible matches, and then using a more precise method to find the correct matches among the possible ones. For example, one way of doing this could be to first calculate the correlation between the search key and the media signal, identifying the sections of media signals that have a high enough correlation with the search key and after this is done test the identified sections in another more precise way. This other way could be using a larger search key or some completely different method.

The search key used to find copies of source material can be composed in different ways. In one way of performing the invention, the used search keys are short, such as 0.1–2 second long sections of the media signal. In another way of performing the invention, the search key might be a representation of a section, for instance by applying a mathematical transformation to that section or by extracting some describing characteristics. In another way of performing the invention, the search keys are much longer and can also be used in combination with compression or using programs or algorithms to, for example, describe a media signal. The different types of search keys can also be used in combinations to better find the desired media signal.

Instead of only using samples, the instantaneous amplitude values, of the media signal in the comparison process, it may be possible to index the music so that a short signal segment may be stored where the segment has some features that distinguishes that segment from other music. For example, a song may have a unique drum segment and only a portion of the drum segment may be stored and compared to other media signals until the same drum segment is located. Any time this drum segment is played again, the segment is stored in an indexed memory so that it is not necessary to search the entire memory but only the indexed portion of the memory. The drum segment may be transformed by a mathematical algorithm in a way to reduce the necessary storage requirements or to facilitate matching.

In another way of performing the invention, the steps of searching for and comparing the stored search keys with current media signals or recorded transmissions, may be done by continuously searching for certain frequencies. For example, the search key may not include the whole frequency register, but only certain predetermined frequencies. When used for music in a radio transmission, the search key may only contain the frequencies 30–31 Hz and 13000–13100 Hz. The 30–31 Hz signal may be used to identify identical drum-sounds in a song of certain lengths at certain time intervals. Similarly, the 13000–13100 Hz signal may be used to identify identical guitar sounds at certain time intervals and lengths. The search procedure may therefore be done by only searching for 30–31 Hz signals of a radio transmission. When a matching signature on the 30–31 Hz frequencies is found in the memory, then the 13000–13100 Hz frequencies are searched and compared. If the media signal has the same guitar sound at the 13000–13100 Hz frequencies, then it is assumed to be the same media signal.

To compare only certain parts of the frequency register may result in better capacity usage compared to searching the whole frequency range. Also, the beginning and the end of a source material may be found by comparing a few frequencies. The signal segments that are compared are considered to be identical as long as the compared frequencies of the signals segments are substantially identical.

The search process may search for embedded codes in the media signal that identifies the transmitted source materials. For example, in digital radio transmission there are possibilities to send codes to identify music that is currently playing. Some CD's contain code that identifies artist and song for each track. This coded information may be used to find the desired song. This information may then be utilized by a procedure for finding the copy of the song and to locate the beginning and end of it and to cut out undesirable signal components.

To be able to quickly find a source material, such as finding a song in an already recorded radio transmission, the memory capacity of the receiving organ must be at least 2–3 hours of stored transmission. For music in standard MP3 format, this is about 100–200 MB of stored music. The memory could also be much larger to be able to, e.g., contain many different media channels over a much longer time period. The memory could also contain previous recordings of source material that the device has found.

The search process may either be triggered by the user when he notices a source material that he would like to have recorded, or by the device itself. When the device is not occupied with a manually triggered search request, it can automatically create search keys and conduct searches to build common-segments libraries or lists stored in memory. These lists of common segments that have been repeated in the media signals can be used for future searches or for playing later on by the user. This automatic searching is particularly useful when a radio station is only playing a limited number of songs, such as a top 40s radio station. For stations that have a greater variety of music a larger buffer memory needs to be searched to find the songs that are repeated, but as soon as a song is repeated the device will identify it and save it. When the user would like to record a song, the device may already have conducted several iterations for a long time period so that the entire song may be available to the listener without having to wait for all the iterations to be completed. By starting the search process among the already identified and saved source materials the search may be much faster, since the desired source material may already earlier have been identified and saved by the device.

In one version of the following invention, the device tests the search key to make sure that it contains sufficient information to be of use. For example, if the device itself has generated a search key automatically, it will not be of any good use if it is in the middle of a silent part of the transmission. This can also happen when the search request is triggered manually. By varying the method of obtaining the search key slightly, the search key can be made as unique as possible. This may lead to a greater chance of finding a match of the search key.

One method of improving the quality of the search key is to test several possible search keys near the time of activation, and select the one that is deemed to be most unique in the sense that it will be of best use to find the desired matching signal segment. Another method of improvement the quality of the search key, when the search key is triggered at a silent moment of the transmission, is to move the taking of the search key to the moment before or the moment after the silence. This enables the device to get a search key that contains more information.

When a search key has been compared to another section of a media signal and the likelihood of them being from the same part of the same source material is high as indicated by some set criterion, then a second step of the identification process can take place. If this actually is a correct match, then it can be assumed that by moving some time before and after the time of the match in both sections and performing a new comparison, then it is likely that the signals still are very similar and thus still from the same source material. At some point in the sections, the likeness will be lower than a certain level, and it can be assumed that an endpoint has been reached of the parts of the sections that are similar. In a similar way the other endpoint may be searched for.

The searching for endpoints can be performed in many ways. The sections may be tested by continuously moving the test along the sections until the lowest likeness level is reached that is deemed to be acceptable, and this is determined to be an endpoint. It is also possible to jump a certain time away from last comparison point and test again, and if still deemed to be sufficiently similar iterate this jumping and testing until the likeness level is below a certain point. The step size could then be reduced and the jump direction reversed This new point is tested and the step size reduced again. The new step direction is changed if the sections are now deemed sufficiently similar, or unchanged if they are deemed not to be sufficiently similar. The iteration process is continued until a predetermined smallest step size is reached, and this is point is taken as an endpoint. The other endpoint can be gotten in the same way.

Since the sections that are compared can originate from different media players and could also have been obtained at different points in time, it is likely that there is a certain speed variance between them. Therefore, it cannot be assumed that the comparison between the two sections when jumping away a certain time into the sections from an earlier comparison point may indicate the greatest similarity at exactly this new point. One should jump some time before this point in one of the sections and then perform comparisons from this point and to a sufficiently later point after the theoretical point and note where the highest similarity was achieved. More mathematically expressed, one jumps a time $t_{Jump}$ in one section and $t_{JUMP-M}$, where M denotes a number of samples, in the other section. Then a comparison of a part around $t_{JUMP-M}$ in the latter section is compared to a same-length part of the other section around $t_{JUMP}$. M is then decreased and the process is iterated until M has reached a certain value, often −M, where the process is terminated.

By making assumptions about device tolerances and other variables involved that can affect the speed of the recordings, it is possible to determine an interval around the expected match position at $t_{JUMP}$ that will still be accepted as sufficiently close as to indicate that the sections at that point still originate from the same source material, provided that the degree of similarity in this point also is sufficiently high. The above can be expanded to give us another way of increasing the probability that the sections at a certain point originate from the same source material. The first method, of course, is to calculate a degree of similarity according to some method, and if the value is better than some set level, then it is likely that it is a correct match. The second method that further assures that the sections are from the same source material in this point is to note how close to the theoretical point in time that the actual maximum similarity is achieved. As an example, we may assume that the comparison process is started 1000 samples before the expected point and continues until 1000 samples after this point and that it has earlier been determined that a correct match must appear within 10 samples before or after the theoretical point. It is now possible to calculate all 2000 possible comparisons and note at which point the best value was obtained.

If this value is within 10 samples from the theoretical point, then there is an increased probability that the sections at this point originate from the same source material. The probability that two unrelated sections will indicate its highest similarity within this 20-sample region is 20/2000=0.01. It can be seen that the longer the search area around the theoretical point the more one can trust a maximum-similarity point within the limits.

After one has jumped a number of steps and found a sufficient degree of similarity within the set limits, it is possible to narrow the limits for further jumps. This is due to the fact that the offset from the expected point may be similar from step to step, and when it has been determined what the expected offset is, then it is possible to set a narrower limit around this offset. It is not likely that device tolerances and other factors that influence the recording speed of a section will vary greatly within a short time period. These two methods, measuring the degree of similarity and only accepting points of maximum similarity within some time limit around the expected point in time, can be used together or only one at a time.

In one version of the following invention the method also includes a counter that counts the number of times the same source material is detected, either in part or full. One may also count the number of times a second instance of the search key is identified. One application of this is that the more times a song has been played, the higher the likelihood that the quality of the final obtained recording of the song is high and that almost the entire song is recorded.

In one version of the present invention, the counting may also be used to generate source material lists that are arranged according to how many times a source material has been played during a certain time period in one or more media channels. For radio, the method can be used to create a list of last weeks most played music on a certain radio station or stations and may rank that music according to how often it has been played.

In one version of the present invention, the method may also generate lists based on the selection and preferences of the user. The user identifies a source material when it is played, activates the device and the source material may automatically be saved in the list of the listener's choice. This maybe one list or a plurality of lists of different source material styles or users; for radio, e.g., a list of Hard Rock, one list of Pop Music and a third list that a friend of the main user of the device has created.

In one version of the present invention, the user may also categorize media channels so that source material played on the same format media channels are saved in the same lists or libraries. For radio e.g., one library might contain hard rock, which is from radio stations that the user knows plays that type of music, and another library is for soft music from that type of radio stations, and so on.

The device may also in one version of performing the invention, identify when a source material is played less frequently and remove such a source material from the list. For example, if the time period between each time the source material is played exceeds a specified time, the source material may be considered to be less popular and thus removed from the top list.

As indicated earlier, the method may remove certain undesirable signal components, such as commercials. For example, the method may remove common segments that are shorter than a certain time period, such as thirty seconds or one minute, because most commercials are shorter than desired source material. The device may recognize the undesired signal components and save them in a separate list.

The method may also remove signal segments that are found being identical over a longer period of time. This is done to remove recordings of total programs that are retransmitted. If, e.g., a radio transmission is identical to another transmission for more than five to ten minutes, it is probably not one song, but instead a retransmission of a full program and thus not of interest to the user who wants to record separate songs. These time parameters may be adjustable to the user so that he might use the device to record both separate source material and collections of source material.

In one version of the present invention it may also be possible for the device to generate lists of material that the user prefers not to be exposed to. This could be done, e.g., by the user pressing an activation button when undesirable material is played. In the radio case, this list could include commercials, talk, jingles, etc. These signal segments may then be stored in an undesired-list that then can be used to screen out these segments from the list of desired material. The user can also mark source material in the desired-list as undesired and thus prevent them from further being played or presented to the user.

In one way of performing the present invention, the user is not exposed to the direct transmission but a slightly delayed version so that the device may have time to remove any undesirable signal components before they reach the user and fill these gaps with desired content. This may be done by automatically searching the transmission for undesired signal components and changing the delay when an undesired signal component is detected to jump over it. This can eventually create gaps big enough to be filled from, e.g., earlier recorded desired material, and when playing of them is over, the source can be switched back to the earlier program.

The device may also automatically change the media channel, such as radio station, when certain conditions are met. For example, the device may change the radio station after a certain time period such as every five minutes or every 24 hours. It could also change radio station when no new songs have been found after a certain time. The change to a new media channel may extend the number of pieces of source material that can be found. The device may also be programmed to find a predefined number of source material, such as twenty, on one media channel and then switch media channel and find a predefined number of different source material on a second media channel. The device may also change media channel when the device cannot find any new source material after a certain time period such as when the device has not found a new source material in forty-eight hours. The device may also switch media channel if no recognizable media signals can be found, such as when there is something wrong with the transmission or the transmitter is inactive.

The device may also store signals from many media channels in a buffer memory. Searching many media channels can increase the chances of eventually obtaining the entire desirable source material, e.g., an entire song.

In one way of using the invention, the device can restart the iteration process to achieve higher quality recordings of source material. When, e.g., recording music from a radio transmission, a too short piece of the desired song can have been gotten or it can have lower quality than desired. The device, or the user using an activation member, might in that case start a process of getting a new search key from the common segments of the source material already recorded which will then lead to a new search for the desired source material in memory or in transmissions.

In another version of the invention the device will connect to an external system for naming of the desired source material. This could be done by the device transmitting a part of the desired source material, or a search key from the desired source material, to the external system and getting a reply which identifies the source material. If the method is used on music in a radio transmission, the device will connect to the system and send a piece of the recorded music for identification. The identification system may send the title of the music, the artist or group to the device, in return. This may make it possible for the user to not only listen to the music but also get the title and to know what artist or group that is playing. This identification could be done automatically or be triggered by the user.

The quality, i.e., the nearness to the source material, of recorded media sections from the same part of the same source material can be improved by utilizing more than one recording of the same source material. If the device has found, for example, three media signals that contain the same source material, undesirable signal components may be removed by replacing a section with undesirable signal components with a corresponding section from the other two media signals that are identical and therefore considered free from undesirable signal components. More particularly, if a certain section of the first media signal has a low similarity to the same section of the second media signal but there is a high similarity between the second section and the third section, then the method may be designed to replace the section of the first media signal with the corresponding section of the second or third media signal.

The search key may operate in a similar way in that the search key will only identify segments that are higher than a certain predetermined value of similarity. If the value of similarity is set too high, then there is a risk that segments that do originate from the same source material may be missed out by the search key. If the value of similarity is set too low, then the wrong signal segment, or poorly transmitted signal segment from the correct source material, may be selected.

Of course, the device may also be set to select the segments that have an equal value of similarity instead of merely maximizing the sound quality to avoid certain sound sections from being extremely clear while others are not so clear. In other words, an entire song may have a small acceptable and evenly distributed level of distortion One method used in one version of the invention to increase the quality of the media signal is to add time-aligned recordings from the same source material together sample by sample, and dividing the resulting amplitude values by the number of recordings taking part in the addition process. The desired signal information may not be affected since it will be the same in all recordings. Undesirable signal components, such as noise and distortion, will not be unaffected in the same way as the wanted signal information. Noise and other similar types of unwanted information, can be regarded as more or less random in nature, and therefore the average noise level may not double when two signals with the same average noise levels are added together. On the average, the resultant noise level only increases by the square root of the number of noise signals added together if they have the same average noise levels. When the amplitude of the wanted signal part is restored by dividing the amplitude values by the number of recordings taking part in the process, the average noise level may be decreased below that of the original recordings.

When noise levels in recordings of the same source material differ more than a certain level, then it is actually better to just select the best recording and not trying to improve the quality by adding the recordings together. Other types of unwanted signal information than noise and similar signals can also be decreased with this method.

If there are only two recordings of the same source material, and they differ quite a bit in quality, then it could be hard to say which one of them would be the best or if they are about of the same quality. A solution for this circumstance would be to add the recordings together and divide the resultant amplitude values by two. It could be so that one of the recording was substantially better than the other, and the best would have been to pick out this recording, but if that was not possible, then the processed version would be the best choice.

If the sections of source material originate from radio transmissions or from other disturbance prone transmission channels, then a possible quality indication can be gotten from the signal strength in the receiver. A weaker reception will generally be more noisy and distorted. Other parameters of the received signal can also be measured and be used to give a quality indication of the obtained source material.

In one version of the following invention, the iteration method of the present invention adds new undisturbed source material segments to a source material segment that is stored in a memory. The device may try to match two segments that are to be spliced together by conducting a mathematical calculation of the similarity of the two segments so that, for example, the end of the first segment is precisely matched with the beginning of the second segment resulting in the two segments are placed exactly right in time. The device may test different overlapping and when the similarity is the highest, the device merges the two segments together, so the user might not notice that a first segment has been added to a second segment.

In one version of the following invention, the device automatically checks if a signal segment is transmitted with inverted phase. The signal segment with inverted phase may have a negative similarity or correlation to a signal segment that is played with opposite phase although they originate from the same part of the same source material. The device may check both the positive and the negative similarity of the search key to be able to use the inverted phase signal segment. In one version of the following invention, if the device detects an inversion of phase of one of the media signals, the device may automatically adjust for this by changing the phase of one of the media signals before merging the two media signals together.

Two sections that are to be merged together might not have their sampling points aligned so that when merged there may be a discontinuity at the meeting point in the final merged section. To make the transition between two sections that are to be merged together as smooth as possible, one may gradually over a limited time near the meeting point mathematically stretch out or compress the signal of one of the sections, or both, so that the merging between the two sections can take place without discontinuity. Another way of solving this problem of discontinuity would be to mathematically shift the sampling points of one, or both, of the sections in a way that the transition will exhibit no discontinuity.

Media signals can be radio transmissions, television transmissions, transmissions over computer networks, computer files, files already stored on the device or equivalent.

Media channels can be radio and television networks, a mobile telephone network, a computer network or equivalent.

A receiving member can be a radio apparatus, a television apparatus, a VCR, a personal computer, a mobile phone or other apparatuses for receiving media signals.

An activating member may be a button, leverage, computer-program, algorithm, steering wheel or equaling member. It may also be voice controlled, infrared or a blue-tooth connection, a wireless connection, or combinations thereof.

All the above members may be used, as well as programmed, automated or time controlled activation members.

Undesirable signal components in the transmissions may be a speech from a radio talker, a DJ, VJ, television person, a reader or news or equivalent. Undesirable signal components in the transmission may also be caused by, for example, the transmission being weak or by any other reason for an interrupted or disturbed transmission.

Source material can be a piece of music, a movie, a commercial, a TV-program, news, a speech, sound effects, film effects or similar.

A detecting member can be made out of an LP filter, HP filter, BP filter, BS filter or active and digital filter constructions for frequency filtering or a computer program, a processor or an algorithm.

An iteration member may, for example, be a computer program or an algorithm.

The final memory may be an internal memory in the media signal player. The final memory may also be a CD-R, mini-disc, floppy disk, hard disk drive, cassette recorder, multimedia card, compact flash card or other external or internal memory or a combination of the above. The final memory may also be part of an external or internal memory or a part of the buffer memory.

A playing member may be a CD-player, minidisk-player, cassette deck, a stereo-equipment, a radio, a television, a VCR, a MP3 player a PC, a PDA or any other device for media playing.

The above-mentioned procedure and arrangement to achieve the goals of the above-mentioned invention can contain both software and hardware or a combination of both.

While the present invention has been described in accordance with preferred compositions and embodiments, it is to be understood that certain substitutions and alterations may be made thereto without departing from the spirit and scope of the following claims.

We claim:

1. A method of identifying segments of media signals received by a receiving device and representing source material whose start and end are not known, storing a first media signal received by the receiving device, the media signal containing both undesirable signal components and said segments of media signals;

selecting a first search key in the first media signal;

searching the media signals for a second search key that is substantially identical to the first search key;

comparing first segments of the first media signal occurring before and after an occurrence of the first search key with second segments of a second media signal occurring before and after an occurrence of the second search key; and identifying said segments of media signals representing said source material by identifying first common segments between the first segments and the second segments.

2. The method according to claim 1 wherein the method further comprises searching subsequent media signals for a third search key that is substantially identical to the first search key;

comparing third segments of a third media signal occurring before and after an occurrence of the third search key with the first segments and second segments; and identifying second common segments between the first segments and the third segments or third common segments between the second segments and the third segments.

3. The method according to claim 2 wherein the method further comprises linking first common segments to the second common segments to form a media signal segment.

4. The method according to claim 2 wherein the method further comprises selecting a longest signal segment of the first common segment, of the second common segment and of the third common segment.

5. The method according to claim 2 wherein the method further comprises determining a first similarity between the first and second segments in the first common segment, determining a second similarity between the second segments and the third segments in the second common segment; and selecting the first common segment when the first similarity shows a higher degree of similarity compared to the second similarity and selecting the second common segment when the second similarity shows a higher degree of similarity compared to the first similarity.

6. The method according to claim 1 wherein the method further comprises the step of manually activating the device to select said first search key by using a first activation member.

7. The method according to claim 1 wherein the method further comprises the step of automatically activating the device.

8. The method according to claim 1 wherein the method further comprises the step of creating a first and second search key;

storing the first and second search key; and searching with the first and second search keys.

9. The method according to claim 1 wherein the method further comprises calculating a similarity factor between the second search key and the first search key.

10. The method according to claim 1 wherein the device uses every (n)th sample of the first media signal when constructing a sample first search key; and further comprising the steps of using the same very (n)th sample of the media signal while searching with the sample first search key; and providing parameter (n) with a value equal to or greater than 1.

11. The method according to claim 1 wherein the method further comprises normalizing signal gain of the media signal.

12. The method according to claim 1 wherein the method further comprises making several copies of the first media signal or several representations of the first media signal and storing the copies or the representations of the first media signal.

13. The method according to claim 1 wherein the method further comprises counting a number of times an identified common segment is received.

14. The method according to claim 1 wherein the method further comprises counting a number of times a second search key is substantially identical to the first search key.

15. The method according to claim 1 wherein the method further comprises producing a first list of common segments.

16. The method according to claim 15 wherein the method further comprises identifying undesirable common segments by activating a second activation member on the device and saving the undesirable common segments in a second list.

17. The method according to claim 16 wherein the method further comprises excluding the common segments in the second list from the first list.

18. The method according to claim 15 wherein the method further comprises selecting common segments that are shorter than a predetermined time period and saving the shorter common segments in a third list.

19. The method according to claim 18 wherein the method further comprises excluding the common segments in the third list from the first list.

20. The method according to claim 1 wherein the method comprises selecting common segments that are longer than a first predetermined time period and excluding the selected common segments that are longer than a second predetermined time period from a first list.

21. The method according to claim 1 wherein the method further comprises comparing the first signal strength at the input of the receiving device at the time period when the first common segments are received with the second signal strength at the input of the receiving device at the time period when the second segments are received; and selecting the first segment when the first signal strength is greater than the second signal strength and selecting the second segment when the second signal strength is greater than the first signal strength.

22. The method according to claim 1 wherein the method further comprises producing a fourth list of common segments based on how often the common segments have been identified over a predetermined time period.

23. The method according to claim 1 wherein the method further comprises producing a fifth list of common segments based on how long since the common segments were last identified.

24. The method according to claim 1 wherein the method further comprises changing media channel when a predetermined time has past and no new common segments have been identified.

25. The method according to claim 1 wherein the method further comprises changing the media channel when a predetermined time has passed since the receiving device last changed media channel.

26. The method according to claim 1 wherein the method further comprises changing the media channel when a specific number of new common segments are identified.

27. The method according to claim 1 wherein the method further comprises searching for a plurality of search keys that are substantially identical to the first search key; and identifying fourth signal segments that are substantially identical to a signal segment from which the first search key was selected.

28. The method according to claim 1 wherein the method further comprises normalizing a signal gain of the media signal where the normalization factor is derived from a sum of absolute values of samples in a selected section.

* * * * *